United States Patent [19]

Davis

[11] 4,376,432

[45] Mar. 15, 1983

[54] FUEL INJECTION PUMP WITH SPILL CONTROL MECHANISM

[75] Inventor: Charles W. Davis, Simsbury, Conn.

[73] Assignee: Stanadyne, Inc., Hartford, Conn.

[21] Appl. No.: 253,208

[22] Filed: Apr. 13, 1981

[51] Int. Cl.[3] ..... F02M 39/00

[52] U.S. Cl. ..... 123/450; 123/501; 123/506; 417/462

[58] Field of Search ..... 123/450, 506, 495, 459, 123/462, 446, 501; 417/462

[56] References Cited

U.S. PATENT DOCUMENTS

| | | | |
|---|---|---|---|
| 2,765,741 | 10/1956 | Hogeman | 123/450 |
| 2,922,370 | 1/1960 | Bischoff | 417/462 |
| 2,935,062 | 5/1960 | Aldinger et al. | 123/450 |
| 3,650,259 | 3/1972 | Garnier | 123/450 |
| 3,752,138 | 8/1973 | Gaines | 123/450 |
| 4,201,170 | 5/1980 | Overfield | 123/450 |

FOREIGN PATENT DOCUMENTS

| | | | |
|---|---|---|---|
| 602501 | 7/1960 | Canada | 123/450 |

*Primary Examiner*—Charles J. Myhre
*Assistant Examiner*—Magdalen Moy
*Attorney, Agent, or Firm*—Prutzman, Kalb, Chilton & Alix

[57] ABSTRACT

A fuel injection pump is provided with an improved spill control mechanism to accurately supply a desired fuel charge to an internal combustion engine. The fuel pump includes a rotor having a charge pump for pressurizing measured charges of fuel for delivery to the engine and a cam ring adapted to rotatably receive the rotor and to actuate the charge pump upon rotation of the rotor. The cam ring is angularly adjustable to control the timing of the pressurized fuel delivery to the engine. A spill collar mounted adjacent to the cam ring and adapted to rotatably receive the rotor includes a spill port for diverting fuel flow from the charge pump upon registration of a spill passage in the rotor with the spill port in the collar. A pivotal crank mounted on the cam ring and engageable with the spill collar is provided for adjusting the angular position of the spill collar relative to the cam ring to control the amount of fuel diverted from the charge pump. The fuel pump preferably includes a governor mechanism operable upon rotation of the rotor and operatively connected to the crank for automatically adjusting the angular position of the spill collar to maintain a desired engine speed.

24 Claims, 9 Drawing Figures

FUEL INJECTION PUMP WITH SPILL CONTROL MECHANISM

The present invention relates to fuel pumps for supplying measured charges of fuel to an associated internal combustion engine and, more particularly, to a fuel injection pump including an adjustable spill control mechanism for accurately supplying a desired fuel charge to the engine.

Fuel injection pumps are known in which a full charge of fuel is delivered to a pumping chamber before each pressurizing stroke and a portion of the fuel charge is spilled or diverted at the termination of the pumping stroke to supply a desired fuel charge to an internal combustion engine. The present invention involves such a fuel injection pump having sufficient adjustment and control of the pressurizing stroke and spill amount to achieve satisfactory operation under all load and speed conditions.

Another object of the present invention is to provide a fuel injection pump having an improved spill control mechanism which permits adjustment, is easily adjusted, and is adapted to the addition of alternative control features for controlling the delivery of fuel to an internal combustion engine.

It is also an object of the invention to provide a fuel injection pump including an improved spill control mechanism comprising an adjustable cam ring to control the timing of the pressurized fuel delivery to the engine and an adjustable spill collar which is directly controlled in accordance with the position of the cam ring to accurately control the fuel charge delivered to the engine.

Another object of the invention is to provide a fuel injection pump with a spill collar control mechanism free of variable scavenging effects which provides uniform fuel distribution to the engine cylinders and minimizes shot-to-shot variation.

It is another object of the invention to provide an improved fuel injection pump of the type described which can deliver excess fuel for cranking.

Furthermore, an object of the invention is to provide a fuel injection pump of the type described including a governor which develops adequate force to accommodate the viscous drag load of the spill collar on the rotor, the frictional forces of the operating mechanism, and the inertia of the pump components.

The accompanying drawings illustrate a preferred embodiment of the invention and, together with the description, serve to explain the principles and operation of the invention.

Figure 1:
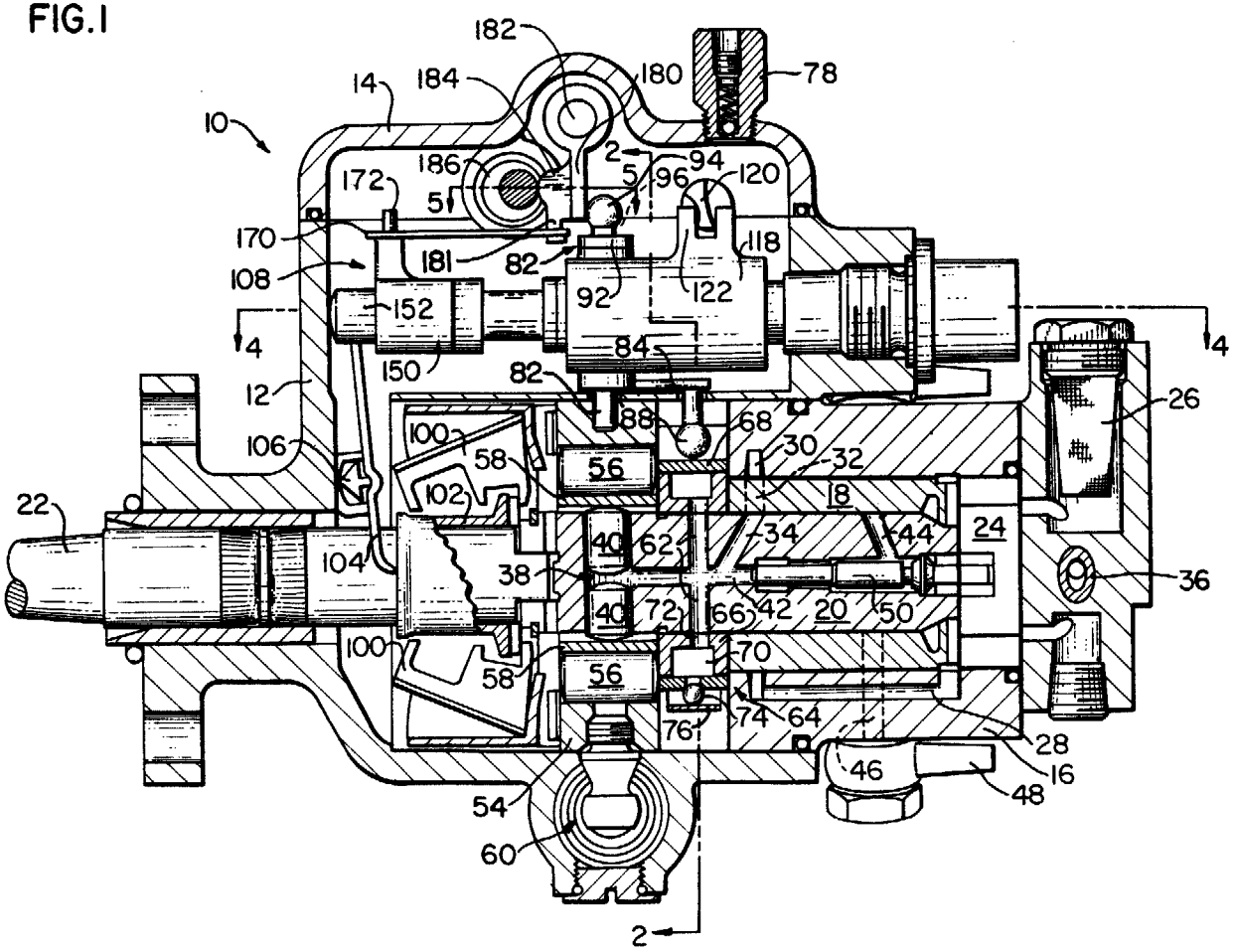
FIG. 1 is an longitudinal cross-sectional view of a fuel injection pump illustrating a preferred embodiment of the present invention.

Referring to FIG. 1, a fuel pump, generally 10, exemplifying the present invention is shown of the type adapted to supply measured pulses or charges of fuel to the several fuel injection nozzles of an internal combustion engine. A pump housing 12 includes a cover 14 secured by suitable fasteners (not shown) and a cylindrical body 16 and a sleeve 18 which rotatably support a pump rotor 20. A drive shaft 22 connected to rotor 20 has a tapered end for receiving a driving gear (not shown) to which the drive shaft may be keyed.

A vane-type transfer or low pressure supply pump 24 driven by rotor 20 receives fuel from a reservoir (not shown) via a pump inlet 26 and delivers the fuel under pressure via an axial conduit 28 and an annular 30 formed in cylindrical body 16 and a plurality of angularly spaced, radial conduits 32 (one shown) formed in sleeve 18 to an inlet passage 34 provided in rotor 20. A transfer pump pressure regulating valve, generally 36, of the type disclosed and described in U.S. Pat. No. 2,833,934, entitled "Pressure Responsive Valve For Fuel Pumps", issued on Apr. 28, 1959, regulates the output pressure of transfer pump 24 and returns excessive fuel to pump inlet 26. Regulator 36 is designed to provide a transfer pump output pressure which increases with engine speed in order to meet the increased fuel requirements of the engine at higher speeds and to provide a fuel pressure usable for operating auxiliary mechanisms of the fuel pump.

A high pressure charge pump 38 driven by rotor 20 comprises a pair of opposed plungers or pistons 40 reciprocable in a diametrical bore or chamber in the rotor. Charge pump 38 receives a predetermined fuel charge from transfer pump 24 when inlet passage 34 moves sequentially into registration with each of the plurality of angularly spaced radial conduits 32 as rotor 20 is rotated. The fuel under high pressure is delivered by the charge pump through an axial bore or main fuel passage 42 in rotor 20 to a radial fuel distributor passage 44 adapted for sequential registration with a plurality of angularly spaced outlet conduits 46 (only one shown) which extend radially through cylindrical body 16 and sleeve 18. Outlet conduits 46, corresponding in number to the engine cylinders, communicate, respectively, with the individual fuel injection nozzles of the engine through a plurality of discharge fittings 48 spaced around the periphery of housing 12. A delivery valve 50 located in axial bore 42 operates in a known manner to achieve sharp cut-off of fuel to the nozzles and eliminate fuel dribble into the engine combustion chambers. Angularly spaced radial inlet passages 32 and angularly spaced outlet passages 46 are located to provide registration, respectively, with diagonal inlet passage 34 during each intake stroke of plungers 40 and with outlet or distributor passage 44 during each compression stroke of the plungers.

An annular cam ring 54 having a plurality of pairs of diametrically opposed camming lobes is provided for actuating plungers 40 of charge pump 38 inwardly to pressurize the charge of fuel supplied to the charge pump chambers. A pair of rollers 56 and roller shoes 58 are mounted in radial alignment with plungers 40 for rotation with rotor 20 and actuation by the camming lobes of cam ring 54 to reciprocate the plungers. For timing the distribution of fuel to the fuel nozzles in correlation with engine operation, annular cam ring 54 is angularly adjustable in relation to the pump housing by a suitable known timing mechanism 60, such for example is disclosed in my prior U.S. Pat. No. 3,771,506, dated Nov. 13, 1973.

A pair of spill passages 62 is formed at diametrically opposed positions in rotor 20 and located between charge pump 38 and inlet passage 34. Spill passages 62 communicate with charge pump 38 via main fuel passage 42. The arrangement of spill passages 62 at diametrically opposed positions provides equalized pressure distribution when fuel is diverted through the passages.

Figure 2:
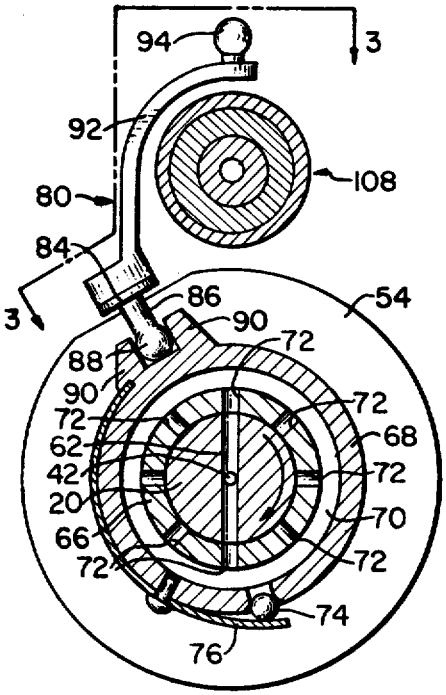
FIG. 2 is an enlarged fragmentary cross-sectional view taken along line 2—2 of FIG. 1 to illustrate the cam ring, spill collar, and bell crank of the preferred embodiment.
Figure 3:
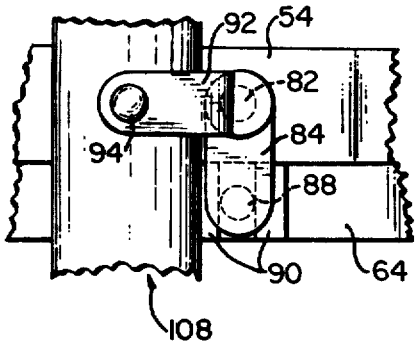
FIG. 3 is an enlarged fragmentary plan view taken along line 3—3 of FIG. 2 to illustrate the connection of the bell crank to the cam ring and spill collar.

An annular spill collar 64 is mounted adjacent to cam ring 54 and is adapted to rotatably receive rotor 20. The spill collar preferably comprises a pair of concentric annular rings 66 and 68 adapted to provide a sealed internal annular passage 70 therebetween. As shown in FIGS. 1 and 2, inner annular ring 66 is U-shaped in cross-section and provided with a plurality of angularly spaced spill ports 72 spaced uniformly about its inner periphery for sequential registration with spill passages 62 upon rotation of rotor 20. Spill ports 72 correspond in number to the cylinders of the internal combustion engine. The spill ports are arranged in diametrically opposed pairs on spill collar 64. Outer annular ring 68 is generally flat and includes a ball-check valve 74 which permits communication between internal annular passage 70 of the spill collar and the interior of pump housing 12. The ball check valve includes an elongated leaf spring 76 which normally biases the ball check valve closed to control the flow of fuel from the internal annular passage to maintain a desired fuel pressure, e.g., 250–600 p.s.i., therein. This minimum pressure is maintained to prevent vapor formation of the fuel in the rotor during spill to assure uniform fuel delivery during sequential pumping strokes and to prevent erosion due to cavitation.

An additional ball check valve 78 is mounted on cover 14 of the housing to allow the fuel spilled into the housing from the spill collar to return to the fuel tank supply. Preferably, ball check valve 78 maintains a fuel pressure of 8–12 p.s.i. in the interior of the pump housing.

As rotor 20 rotates, fuel from transfer pump 24 is supplied to completely fill charge pump 38 when inlet passage 34 moves into registration with one of the angularly spaced conduits 32. Then, as fuel inlet passage 34 moves out of registration with conduit 32 fuel distributor passage 44 moves into registration with one of the angularly spaced outlet conduits 46 and plungers 40 are cammed inwardly by the camming lobes on cam ring 54 to pressurize the fuel in the charge pump chamber. Pressurized fuel is then delivered through the corresponding discharge fitting 48 to a fuel injection nozzle (not shown) of the engine. After a portion of the pumping stroke is completed, spill passages 62 move into registration with spill ports 72 to divert the remainder of the fuel in the charge pump chamber through internal annular passage 70 in spill collar 64 to the interior of pump housing 12.

The amount of fuel diverted through spill collar 64 is determined by the timing of the registration of spill passages 62 with spill ports 72 in the pumping stroke. This timing is controlled by the angular relationship between spill collar 64 and cam ring 54. If the spill collar is adjusted to provide registration between spill passages 62 and spill ports 72 early in the pumping stroke, then an increased amount of fuel is diverted to reduce the fuel charge delivered to the engine. On the other hand, if spill collar 64 is adjusted to provide registration between spill passages 62 and spill ports 72 late in the pumping stroke, or after the pumping stroke is completed, then little or no fuel is diverted and a full charge is supplied to the engine.

In accordance with the invention, crank means is pivotally mounted on the cam ring and engageable with the spill collar for adjusting the angular position of the collar relative to the cam ring to control the amount of fuel diverted from the charge pump. The preferred embodiment includes a ball crank, generally 80 (FIGS. 1 and 2), pivotally mounted on a radial pin 82 fixed in a hole formed in cam ring 54. A first, lower arm 84 of the bell crank extends axially between cam ring 54 and spill collar 64 and includes a depending stem 86 supporting a ball 88 at its lower end. A pair of upstanding flanges 90 formed on outer annular ring 68 provide a slot therebetween for receiving ball 88. The ball and slot connection allows the spill collar to be angularly adjusted relative to cam ring 54 when the bell crank pivots about pin 82. A second, upper arm 92 of the bell crank, which extends at right angles relative to lower bell crank arm 84, curves upwardly into a horizontal orientation and terminates close to the center line of the pump. The upper end of bell crank arm 92 includes a ball 94 supported on an upwardly extending stem 96. When the upper end of bell crank arm 92 is moved axially, in a direction parallel to the rotor axis, spill collar 64 is moved angularly relative to cam ring 54 via the pivotal movement of lower bell crank arm 84 transmitted to the spill collar by the ball and slot connection.

Referring to FIG. 1, a plurality of governor weights 100, angularly spaced about pump shaft 22, provide a variable bias on a sleeve 102, slidably mounted on the pump shaft, which engages a governor arm 104 to urge it clockwise about a supporting pivot 106. The movement of governor arm 104 is transmitted to bell crank 80 via a connector mechanism, generally 108 (FIGS. 1 and 4).

Figure 4:
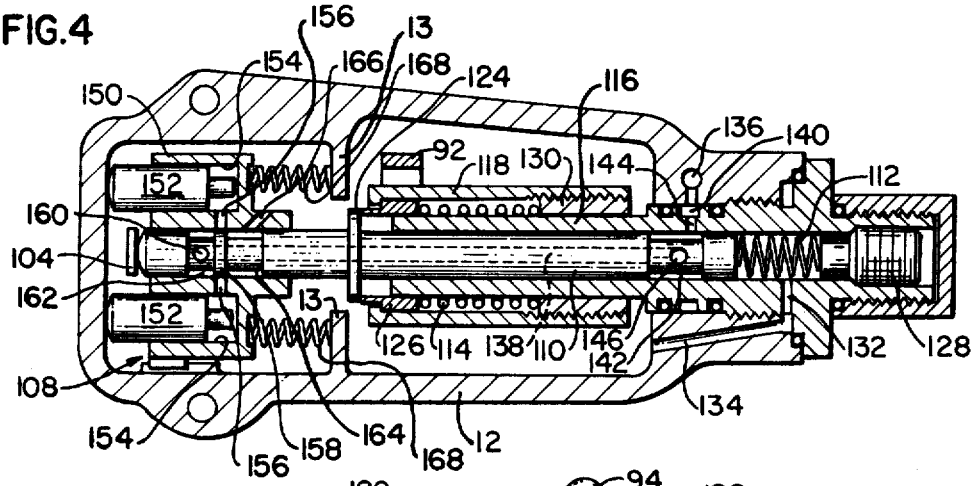
FIG. 4 is an enlarged fragmentary cross-sectional view taken along line 4—4 of FIG. 1 illustrating a hydraulically operated connector between the bell crank and the governor mechanism of the pump.

As shown in FIG. 4, a hydraulically actuated connector is used to couple the governor arm and the bell crank.

As shown, the pump is provided with min.-max. governing with the upper end of governor arm 104 engaging the left end of a servo valve 110 urging it rightward against the force of an idle spring 112 and a reloaded high speed spring 114. Servo valve 110 is slidably supported in a hollow elongated guide stud 116, threadably received in a suitable opening provided in the right end of pump housing 12. A governor sleeve member 118, which contains high speed spring 114, is slidably mounted on an elongated shank portion of guide stud 116. Governor sleeve member 118 is held in a desired position by an eccentric portion of a throttle shaft 120 (FIG. 1) which is engaged in a slot located between a pair of shoulders 122 formed on top of the sleeve. A flange 124 (FIG. 4) formed on servo valve 110 engages a spring seat 126 at the left end of high speed spring 114 which can slide into sleeve member 118 when the spring is compressed. The loads on springs 112 and 114 are adjustable by suitable threaded members 128 and 130, respectively, received in the guide stud and sleeve. These members allow the idle and maximum speeds to be adjusted.

A radial passage 132 is provided in guide stud 116 which communicates with an axial passage 134 in pump housing 12 to vent the idle spring chamber to the interior of the pump housing. Transfer pressure is transmitted from a housing passage 136 to a central bore 138 provided in servo valve 110 via annular grooves 140 and 142 and radial passages 144 and 146 provided in guide stud 116 and servo valve 110, respectively.

A hydraulically powered block member 150 which is non-rotatably and slidably mounted relative to pump housing 12 includes a central bore which slidably receives the left end of servo valve 110. Block member 150 contains a pair of piston 152 urged against the left end of housing 12 by pressure supplied to a pair of chambers 154 in the block member. A pair of radial ports 156 extend through block member 150 between chambers 154 and its central bore. Ports 156 are controlled by a land 158 formed on servo valve 110, either to admit transfer pressure to chambers 154 from central bore 138 in the servo valve via a radial passage 160 and an annulus 162, or to vent pressure from the chambers to the pump housing via an annulus 164 and vent hole 166. Springs 168 which abut flanges 13 of pump 12 urge block member 150 leftward.

A link 170 (FIG. 1) is shown as being connected to pivoted plate 180 and block member 150. Link 170 includes suitable openings at its opposite ends for receiving stem 181 on pivoted plate 180 and an upstanding pin 172 provided on block member 150. The ball 94 is urged against pivoted plane 180 by viscous drag or spill collar 64.

When the hydraulic connector mechanism is operating under equilibrium conditions, land 158 (FIG. 4) closes radial ports 156. If servo valve 110 moves rightward in response to a speed increase, or in response to rightward motion of sleeve 118, ports 156 become opened to annulus 162 to supply transfer pressure to chambers 154. As a result, pistons 152 are urged leftward against the interior wall of pump housing 12 and block member 150 is moved rightward until ports 156 are again closed. On the other hand, when valve 110 moves leftward, ports 156 are opened to annulus 164 and pressure is vented from chambers 154 to move block member 150 leftward until ports 156 are closed.

In the operation of the hydraulically operated connector mechanism, block member 150 follows the motion of servo valve 110 in response to movement of governor arm 104. The resultant force exerted on block member 150 is determined by the transfer pressure and piston diameter and is independent of the force applied by governor weights. Consequently, light governor weights and low force governor springs can be successfully employed.

Motion of governor arm 104 resulting from an increase in engine speed moves block member 150, link 170 and pivoted plate 180 rightward toward the transfer end of the pump (as viewed in FIG. 1) and permits ball 94 to also move rightward to rotate spill collar 64 in a counterclockwise direction relative to cam ring 54 (as viewed in FIG. 2) to a position of reduced fuel delivery. On the other hand, when the speed decreased, leftward motion of block member 150, link 170 and pivoted plate 180 (FIG. 1) toward the drive end of the pump urges ball 94 to the left to cause clockwise movement of spill collar 64 relative to cam ring 54 (FIG. 2) to increase the fuel delivery.

As shown in FIG. 1, motion of upper bell crank arm 92 is controlled by contact of its ball 94 with pivoted plate 180 with the ball 94 being held against the plate 94 by the viscous drag on spill collar 64. The surface of pivoted plate 180 engaging ball 94 is perpendicular to the axis of the rotor and is sufficiently wide to accommodate the side-to-side motion of ball 94 that occurs as the angular position of the cam ring changes with speed. Pivoted plate 180 is pivotally mounted on a shaft 182 extending transversely across pump cover 14. A tab 184 projecting from the pivoted stop plate 180 engages a profile on a torque piston 186 mounted on cover 14 parallel to pivot shaft 182. The torque piston 186 is movable axially in response to the pump transfer pressure delivered to chamber 188 by passage 189 (FIG. 5) which increases with engine speed. Maximum movement of pivoted stop plate 180 toward the drive end of the pump is limited by the axial position of torque piston 186. As a result, the stop plate serves as a variable maximum fuel stop depending on the profile 190 of the torque piston to provide a desired maximum fuel delivery curve. Thus, the torque piston 186 and stop plate 180 provide a governor override mechanism to limit the maximum fuel delivery achieved by the governor mechanism.

Automatic excess fuel can be obtained by providing a suitable notch 192 at the low speed end of the torque piston profile.

Preferably, and as shown, the profile 190 of torque piston 186 is formed eccentrically to allow adjustment of the maximum fuel delivery curve by shifting the angular position of the torque piston by a suitable rotatable shifting means 194. The shifting means 194 may be automatically responsive to an engine operating parameter such as intake manifold pressure or altitude by manipulating the angular position of eccentric shaft 182 by a suitable control arrangement (not shown). As shown, the shifting means is locked in adjusted position by a lock nut 196. The maximum fuel, altitude or manifold pressure adjustments do not change the shape of the maximum delivery curve significantly. In addition, these adjustment features are located in pump cover 14 to provide ready access and, if desired, can be eliminated.

Figure 6:
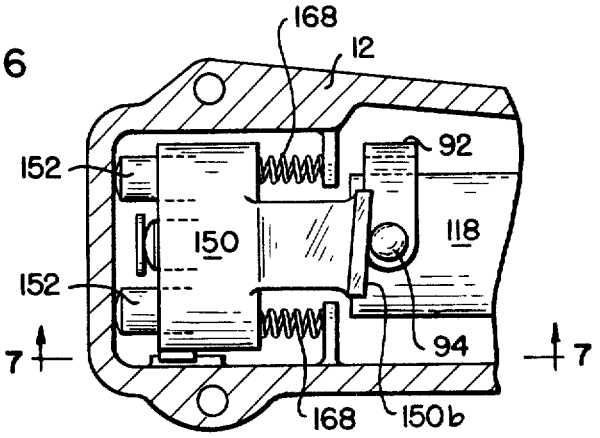
FIG. 6 is an enlarged fragmentary cross-sectional view similar to FIG. 4 of a modified form of the invention.
Figure 7:
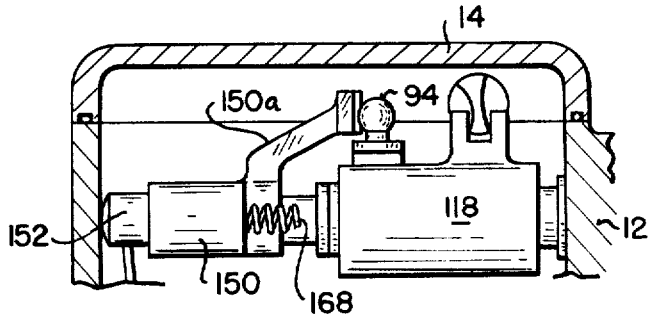
FIG. 7 is a fragmentary view taken along the line 7—7 of FIG. 6.

A modified form of the invention is illustrated in FIGS. 6 and 7.

In this form of the invention, the pivoted plate 180, the torque control piston 186, and the connecting link 170 between the axially slidable block member 150 and the pivoted plate 180 which are a part of the form of the invention of FIGS. 1–5, are eliminated and an axially extending cam plate **150*a* formed integrally with block member 150 is substituted therefor. Cam plate 150*a* has a profiled cam surface 150*b* which engages ball 94. Since viscous drag on the spill collar 64 keeps the ball 94 in contact with the profiled cam surface 150*b*, it will be apparent as the cam ring 54 shifts angularly with speed to perform its customary function of changing the timing of the injection stroke of the pumping plungers 40 with speed, ball 94 will contact the profiled cam surface 150*b*, which is non-perpendicular to the axis of rotation of the pump, at different axial positions to change the maximum stroke of the pumping plungers 40**.

Since the ball 94 moves side-to-side in a direction generally parallel to cam surface 150*b* in direct response to the angular shift of the cam ring 54, the maximum delivery per pumping stroke by the fuel injection pump prior to termination of delivery is changed according to the profile of cam surface 150*b* for varying speeds.

The spring force of springs 168 is made greater than the force of pistons 152 when speed is less than idle speed so that block member 150 is moved to its full leftward axial position (as viewed in FIG. 6) as such low speeds. As a result, the pump provides excess fuel for starting since the cam surface 150*b* is not effective to limit the quantity of fuel delivered by the pumping stroke below idle speed.

When idle speed is reached after starting, transfer pump pressure becomes sufficiently high to overcome the force of springs 168 and normal hydraulic torque control is restored.

Figure 8:
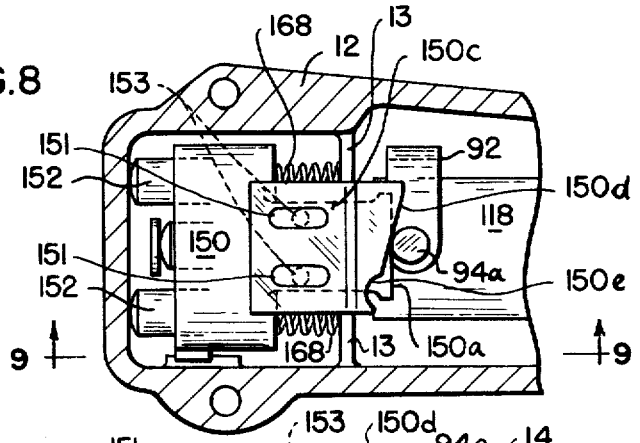
FIG. 8 is an enlarged fragmentary cross-sectional view similar to FIG. 6 of another modified form of the invention.
Figure 9:
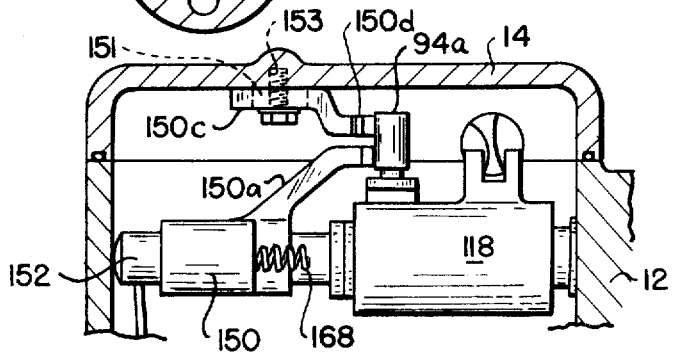
FIG. 9 is a fragmentary view taken along line 9—9 of FIG. 8.

Another modified form of the invention is illustrated by FIGS. 8 and 9.

This form of the invention is very similar to the modified form of FIGS. 6 and 7 except that the cam surface 150*a* is made perpendicular to the axis of rotation of the pump so that it does not vary the maximum fuel delivery according to speed as does the modified form of FIGS. 6 and 7.

In the design of FIGS. 8 and 9, the torque control function is provided by a separate cam plate 150*c* mounted by pump cover 14. In this modified form, the ball 94 is elongated as shown at 94*a* in FIG. 9 to engage both the cam surface 150*a* which is axially movable during operation as hereinbefore described and the angled cam surface 150*d* of cam plate 150*c*. The cam plate 150*c* may be axially adjustable so that the axial position of the cam surface 150*d* may be shifted according to an engine operating parameter such as intake manifold pressure or to provide altitude compensation by means not shown. As shown, the axial position is fixed by screws 153 received in axial slots 151 for adjusting the level of the torque curve.

As shown, a notch 150*e* may be provided for permitting the elongated ball 94*a* to move further to the left during starting to provide excess fuel.

Figure 5:
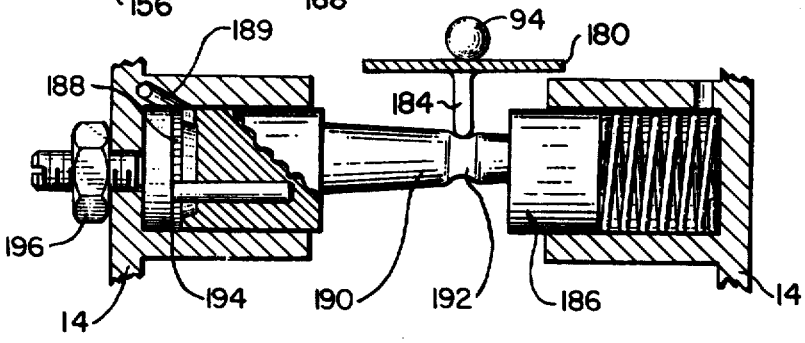
FIG. 5 is an enlarged fragmentary cross-sectional view taken along line 5—5 of FIG. 1.

The modified forms of FIGS. 6–9 differ from that of FIGS. 1–5 in that the speed signal in the two modified forms is obtained directly from the angular position of cam ring 54 rather than from a hydraulically controlled speed sensitive piston 186 as shown in FIG. 5.

The present invention is not limited to the specific details shown and described, and modifications in the fuel injection pump construction can be made without departing from the scope of the invention.

We claim:

1. In a fuel injection pump for an internal combustion engine:

a rotor including a charge pump for pressurizing measured charges of fuel for delivery to the engine, said rotor including a spill passage in communication with said charge pump;

a first annular member providing a cam ring surrounding said rotor and operatively coupled to said charge pump for actuating said charge pump upon rotation of said rotor, said cam ring being angularly adjustable to control the timing of the pressurized fuel delivery to the engine;

a second annular member providing a spill collar mounted adjacent to said cam ring and rotatably receiving said rotor, said spill collar including a spill port formed therein for diverting fuel flow from said charge pump upon registration of said spill passage in said rotor with said spill port in said collar;

crank means interconnecting said annular members for angular adjustment of said collar together with said cam ring and pivotally mounted on one of said annular members and connected to the other of said annular members for adjusting the angular position of said collar relative to said cam ring upon pivotal movement of said crank means on said one annular member to control the amount of fuel diverted from said charge pump; and timing control means for angularly adjusting the cam ring for angularly adjusting said collar and said cam ring together and for angularly adjusting said collar relative to said cam ring with the crank means.

2. The fuel injection pump of claim 1, which includes:

governor means operable upon rotation of said rotor and operatively connected to said crank means for adjusting the angular position of said spill collar to maintain a desired speed of operation of the engine.

3. In a fuel injection pump for an internal combustion engine:

a rotor including a chamber formed therein for receiving measured charges of fuel, a set of reciprocable pistons mounted in said chamber for pressurizing the measured charges of fuel, and a fuel distributor passage in communication with said chamber for delivering the measured charges of pressurized fuel to the engine, said rotor also including a spill passage in communication with said chamber;

a first annular member providing a cam ring surrounding said rotor and operatively engageable with said pistons for reciprocating said pistons upon rotation of said rotor to pressurize the measured charges of fuel received in said chamber, said cam ring being angularly adjustable to control the timing of reciprocation of said pistons;

a second annular member providing a spill collar mounted adjacent to said cam ring and adapted to rotatably receive said rotor, said spill collar including a spill port formed therein for diverting fuel flow from said fuel passage when said spill passage in said rotor is moved into registration with said spill port in said collar;

a bell crank interconnecting said annular members for angular adjustment of said collar together with said cam ring and pivotally mounted on one of said annular members and connected to the other of said annular members for adjusting the angular position of said collar relative to said cam ring upon pivotal movement of said crank on said one annular member to control the amount of fuel diverted from the engine; and timing control means for angularly adjusting the cam ring for angularly adjusting said collar and said cam ring together and for angularly adjusting said collar relative to said cam ring with the bell crank.

4. The fuel injection pump of claim 3, wherein:

said rotor includes a main fuel passage in communication with said chamber extending axially along its center, said fuel distributor passage and said spill passage extending radially outward from said main fuel passage; and said spill collar includes a plurality of angularly spaced spill ports formed therein for sequential registration with said spill passage as said rotor is rotated.

5. The fuel injection pump of claim 3, which includes:

governor means operable upon rotation of said rotor and operatively connected to said bell crank for adjusting the angular position of said spill collar to maintain a desired speed of operation of the engine.

6. In a fuel injection pump for an internal combustion engine;

a rotor including a chamber formed therein for receiving measured charges of fuel, a set of reciprocable pistons mounted in said chamber for pressurizing the measured charges of fuel, and a fuel distributor passage in communication with said chamber for delivering the measured charges of pressurized fuel to the engine, said rotor also including a spill passage in communication with said chamber;

a cam ring adapted to rotatably receive said rotor and operatively engageable with said pistons for reciprocating said pistons upon rotation of said rotor to pressurize the measured charges of fuel received in said chamber, said cam ring being angularly adjustable to control the timing of reciprocation of said pistons;

a spill collar mounted adjacent to said cam ring and adapted to rotatably receive said rotor, said spill collar including a spill port formed therein for diverting fuel flow from said fuel passage when said spill passage in said rotor is moved into registration with said spill port in said collar; and a bell crank pivotally mounted on said cam ring and engageable with said spill collar for adjusting the angular position of said collar relative to said cam ring upon pivotal movement of said crank to control the amount of fuel diverted from the engine;

said rotor including a main fuel passage in communication with said chamber extending axially along its center, said fuel distributor passage and said spill passage extending radially outward from said main fuel passage;

said spill collar including a plurality of angularly spaced spill ports formed therein for sequential registration with said spill passage as said rotor is rotated and a pair of concentric annular rings adapted to provide an internal annular passage therebetween in communication with said spill ports for receiving the fuel diverted through said spill ports.

7. The fuel injection pump of claim 6, which includes:

valve means on said outer annular ring for controlling the flow of fuel from said internal annular passage to maintain a desired fuel pressure in said internal annular passage.

8. In a fuel injection pump for an internal combustion engine:

a rotor including a chamber formed therein for receiving measured charges of fuel, a set of reciprocable pistons mounted in said chamber for pressurizing the measured charges of fuel, and a fuel distributor passage in communication with said chamber for delivering the measured charges of pressurized fuel to the engine, said rotor also including a spill passage in communication with said chamber;

a cam ring adapted to rotatably receive said rotor and operatively engageable with said pistons for reciprocating said pistons upon rotation of said rotor to pressurize the measured charges of fuel received in said chamber, said cam ring being angularly adjustable to control the timing of reciprocation of said pistons;

a spill collar mounted adjacent to said cam ring and adapted to rotatably receive said rotor, said spill collar including a spill port formed therein for diverting fuel flow from said fuel passage when said spill passage in said rotor is moved into registration with said spill port in said collar;

a bell crank pivotally mounted on said cam ring and engageable with said spill collar for adjusting the angular position of said collar relative to said cam ring upon pivotal movement of said crank to control the amount of fuel diverted from the engine;

governor means operable upon rotation of said rotor and operatively connected to said bell crank for adjusting the angular position of said spill collar to maintain a desired speed of operation of the engine; and a governor override mechanism for limiting motion of said bell crank in the direction of increased fuel delivery to control the maximum amount of fuel delivered to the engine during each injection according to engine speed.

9. A fuel injection pump for an internal combustion engine having a plurality of cylinders, comprising:

a housing;

a rotor rotatably mounted within said housing and provided with a chamber formed therein for receiving measured charges of fuel, a set of reciprocable pistons mounted in said chamber for pressurizing the measured charges of fuel, a fuel distributor passage in communication with said chamber for delivering the measured charges of pressurized fuel to the engine, and a spill passage in communication with said chamber;

a first annular member providing a cam ring supported on said housing and surrounding said rotor, said cam ring being operatively engageable with said pistons for reciprocating said pistons upon rotation of said rotor to pressurize the measured charges of fuel received in said chamber, said cam ring being angularly adjustable relative to said housing to control the timing of reciprocation of said pistons;

said housing including a plurality of fuel delivery passages formed therein and arranged for sequential registration with said fuel distributor passage upon rotation of said rotor for delivering the measured charges of pressurized fuel to the cylinders of the engine;

a second annular member providing an annular spill collar mounted within said housing adjacent to said cam ring and rotatably receiving said rotor, said collar including a plurality of radial spill ports formed therein and corresponding in number to the cylinders of the engine for diverting fuel flow from said fuel distributor passage when said spill passage in said rotor is moved into registration with any of said spill ports in said collar;

a bell crank interconnecting said annular members for angular adjustment of said collar together with said cam ring and pivotally mounted on one of said annular members and connected to the other of said annular members for adjusting the angular position of said collar relative to said cam ring upon pivotal movement of said crank on said one annular member to control the amount of fuel diverted from the cylinders of the engine; and timing control means for angularly adjusting the cam ring for angularly adjusting said collar and said cam ring together and for angularly adjusting said collar relative to said cam ring with the bell crank.

10. The fuel injection pump of claim 9, wherein:

said rotor includes a main fuel passage extending radially outward from said main fuel passage, and a pair of diametrically opposed spill passages extending radially outward from said main fuel passage; and said annular collar includes a plurality of angularly spaced, diametrically opposed spill ports formed therein for registration with said pair of spill passages as said rotor is rotated.

11. The fuel injection pump of claim 9, which includes:

governor means operable upon rotation of said rotor and operatively connected to said bell crank for adjusting the angular position of said spill collar to maintain a desired speed of operation of the engine.

12. A fuel injection pump for an internal combustion engine having a plurality of cylinders, comprising:

a housing;

a rotor rotatably mounted within said housing and provided with a chamber formed therein for receiving measured charges of fuel, a set of reciprocable pistons mounted in said chamber for pressurizing the measured charges of fuel, a fuel distributor passage in communication with said chamber for delivering the measured charges of pressurized fuel to the engine, and a spill passage in communication with said chamber;

a cam ring supported on said housing and adapted to rotatably receive said rotor, said cam ring being operatively engageable with said pistons for reciprocating said pistons upon rotation of said rotor to pressurize the measured charges of fuel received in said chamber, said cam ring being angularly adjustable relative to said housing to control the timing of reciprocation of said pistons;

said housing including a plurality of fuel delivery passages formed therein and arranged for sequential registration with said fuel distributor passage upon rotation of said rotor for delivering the measured charges of pressurized fuel to the cylinders of the engine;

an annular spill collar mounted within said housing adjacent to said cam ring and adapted to rotatably receive said rotor, said collar including a plurality of radial spill ports formed therein and corresponding in number to the cylinders of the engine for diverting fuel flow from said fuel distributor passage when said spill passage in said rotor is moved into registration with any of said spill ports in said collar; and a bell crank pivotally mounted on said cam ring and engageable with said annular spill collar for adjusting the angular position of said collar relative to said cam ring upon pivotal movement of said crank to control the amount of fuel diverted from the cylinders of the engine;

said spill collar comprising an inner annular ring and an outer annular ring adapted to provide an internal annular passage therebetween for receiving the fuel diverted through said spill ports, said spill ports being formed in said inner annular ring and said outer annular ring having a passage communicating with the interior of said housing.

13. The fuel injection pump of claim 12, which includes:

a spring-biased ball check valve mounted on said outer annular ring and providing communication between said internal annular passage and the interior of said housing for controlling the flow of fuel from said internal annular passage to the interior of the said housing to maintain a desired fuel pressure in said internal annular passage.

14. A fuel injection pump for an internal combustion engine having a plurality of cylinders, comprising:

a housing;

a rotor rotatably mounted within said housing and provided with a chamber formed therein for receiving measured charges of fuel, a set of reciprocable pistons mounted in said chamber for pressurizing the measured charges of fuel, a fuel distributor passage in communication with said chamber for delivering the measured charges of pressurized fuel to the engine, and a spill passage in communication with said chamber;

a cam ring supported on said housing and adapted to rotatably receive said rotor, said cam ring being operatively engageable with said pistons for reciprocating said pistons upon rotation of said rotor to pressurize the measured charges of fuel received in said chamber, said cam ring being angularly adjustable relative to said housing to control the timing of reciprocation of said pistons;

said housing including a plurality of fuel delivery passages formed therein and arranged for sequential registration with said fuel distributor passage upon rotation of said rotor for delivering the measured charges of pressurized fuel to the cylinders of the engine;

an annular spill collar mounted within said housing adjacent to said cam ring and adapted to rotatably receive said rotor, said collar including a plurality of radial spill ports formed therein and corresponding in number to the cylinders of the engine for diverting fuel flow from said fuel distributor passage when said spill passage in said rotor is moved into registration with any of said spill ports in said collar;

a bell crank pivotally mounted on said cam ring and engageable with said annular spill collar for adjusting the angular position of said collar relative to said cam ring upon pivotal movement of said crank to control the amount of fuel diverted from the cylinders of the engine, and governor means operable upon rotation of said rotor and operatively connected to said bell crank for adjusting the angular position of said spill collar to maintain a desired speed of operation of the engine;

the governor means including a plurality of governor weights mounted for rotation with said rotor;

a control arm operable by said governor weights upon rotation of said rotor; and a hydraulically operated connector between said control arm and said bell crank for operating said bell crank in response to movement of said control arm to adjust the angular position of said spill collar.

15. A fuel injection pump for an internal combustion engine having a plurality of cylinders, comprising:

a housing;

a rotor rotatably mounted within said housing and provided with a chamber formed therein for receiving measured charges of fuel, a set of reciprocable pistons mounted in said chamber for pressurizing the measured charges of fuel, a fuel distributor passage in communication with said chamber for delivering the measured charges of pressurized fuel to the engine, and a spill passage in communication with said chamber;

a cam ring supported on said housing and adapted to rotatably receive said rotor, said cam ring being operatively engageable with said pistons for reciprocating said pistons upon rotation of said rotor to pressurize the measured charges of fuel received in said chamber, said cam ring being angularly adjustable relative to said housing to control the timing of reciprocation of said pistons;

said housing including a plurality of fuel delivery passages formed therein and arranged for sequential registration with said fuel distributor passage upon rotation of said rotor for delivering the measured charges of pressurized fuel to the cylinders of the engine;

an annular spill collar mounted within said housing adjacent to said cam ring and adapted to rotatably receive said rotor, said collar including a plurality of radial spill ports formed therein and corresponding in number to the cylinders of the engine for diverting fuel flow from said fuel distributor passage when said spill passage in said rotor is moved into registration with any of said spill ports in said collar;

a bell crank pivotally mounted on said cam ring and engageable with said annular spill collar for adjusting the angular position of said collar relative to said cam ring upon pivotal movement of said crank to control the amount of fuel diverted from the cylinders of the engine;

governor means operable upon rotation of said rotor and operatively connected to said bell crank for adjusting the angular position of said spill collar to maintain a desired speed of operation of the engine; and a governor override mechanism including an adjustable stop responsive to engine speed and engageable with said bell crank for limiting motion of said bell crank in the direction of increased fuel delivery to control the maximum amount of fuel delivered to the engine during each injection according to engine speed.

16. In a fuel injection pump for an internal combustion engine:

a rotor including a chamber formed therein for receiving measured charges of fuel, a set of reciprocable pistons mounted in said chamber for pressurizing the measured charges of fuel, and a fuel distributor passage in communication with said chamber for delivering the measured charges of pressurized fuel to the engine, said rotor also including a spill passage in communication with said chamber;

a cam ring adapted to rotatably receive said rotor and operatively engageable with said pistons for reciprocating said pistons upon rotation of said rotor to pressurize the measured charges of fuel received in said chamber, said cam ring being angularly adjustable to control the timing of reciprocation of said pistons;

a spill collar mounted adjacent to said cam ring and adapted to rotatably receive said rotor, said spill collar including a spill port formed therein for diverting fuel flow from said fuel passage when said spill passage in said rotor is moved into registration with said spill port is said collar;

a bell crank pivotally mounted on said cam ring and engageable with said spill collar for adjusting the angular position of said collar relative to said cam ring upon pivotal movement of said crank to control the amount of fuel diverted from the engine;

governor means operable upon rotation of said rotor and operatively connected to said bell crank for adjusting the angular position of said spill collar to maintain a desired speed of operation of the engine; and a governor override mechanism for limiting motion of said bell crank in the direction of increased fuel delivery to control the maximum amount of fuel delivered to the engine during each injection according to engine speed.

17. The fuel injection pump of claim 8, including:

means for rendering said governor override mechanism inoperative for limiting fuel delivery during engine cranking.

18. The fuel injection pump of claim 8, including:

means for rendering said governor override mechanism inoperative for limiting fuel delivery below idle speed.

19. The fuel injection pump of claim 8, wherein:

the governor override mechanism includes a profiled cam adjustable to shift the maximum fuel delivery by the pump during each injection at all engine speeds above idle speed.

20. The fuel injection pump of claim 19, wherein:

the profiled cam is adjustable according to an engine operating parameter.

21. The fuel injection pump of claim 20, wherein:

the engine operating parameter is intake manifold pressure.

22. The fuel injection pump of claim 20, wherein:

the engine operating parameter is the altitude of engine operation.

23. The fuel injection pump of claim 17, wherein:

the governor override mechanism is a profiled cam mounted by the pump housing.

24. The fuel injection pump of claim 23, wherein:

the profiled cam is shiftable to change the maximum amount of fuel delivered to the engine during each injection at all engine operating speeds.

* * * * *